United States Patent [19]

Erwin

[11] 4,349,314

[45] Sep. 14, 1982

[54] COMPRESSOR DIFFUSER AND METHOD

[75] Inventor: John R. Erwin, Paradise Valley, Ariz.

[73] Assignee: The Garrett Corporation, Los Angeles, Calif.

[21] Appl. No.: 151,070

[22] Filed: May 19, 1980

[51] Int. Cl.[3] ..... F04D 29/44

[52] U.S. Cl. ..... 415/181; 415/207; 415/211

[58] Field of Search ..... 415/181, 207, 211

[56] References Cited

U.S. PATENT DOCUMENTS

| | | | |
|---|---|---|---|
| 2,967,013 | 1/1961 | Dallenbach | 415/181 |
| 3,778,186 | 12/1973 | Bandukwala | 415/211 X |
| 3,781,128 | 12/1973 | Bandukwalla | 415/211 |
| 4,181,467 | 1/1980 | Campbell | 415/211 X |

*Primary Examiner*—Leonard E. Smith

*Attorney, Agent, or Firm*—James W. McFarland; J. Richard Konneker; Albert J. Miller

[57] ABSTRACT

An improved diffuser for fluid flow compressors which utilizes alternately swept diffuser vanes.

19 Claims, 15 Drawing Figures

FIG. 3
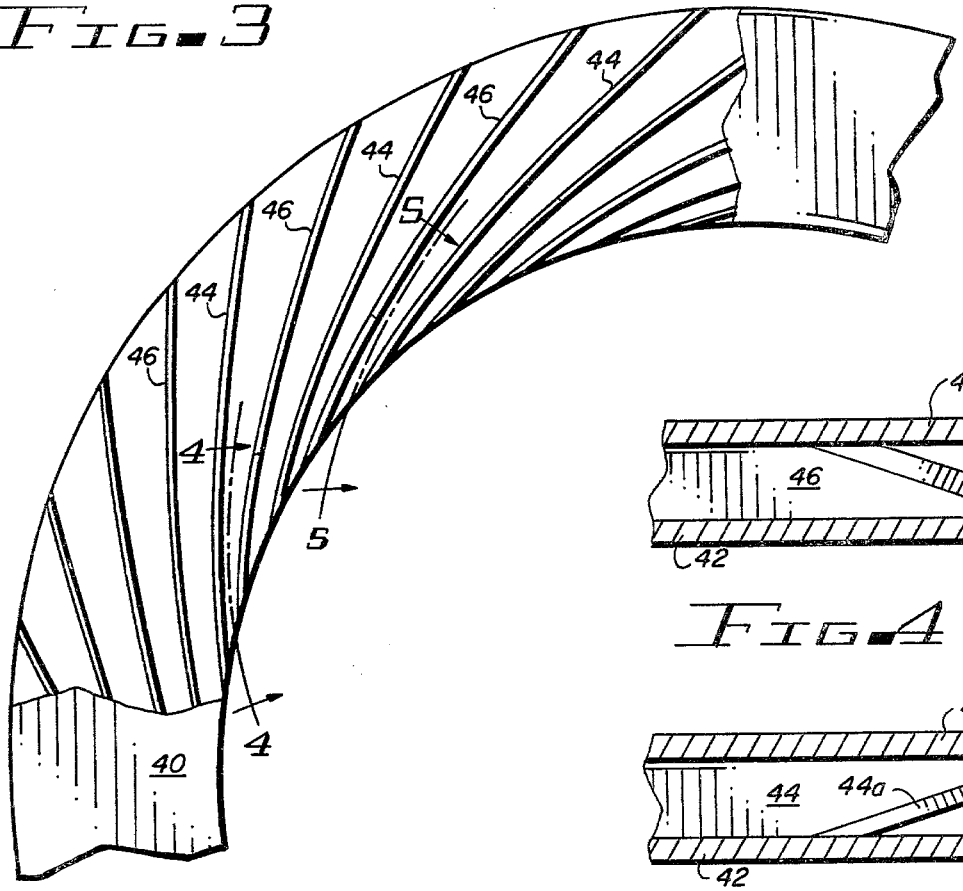
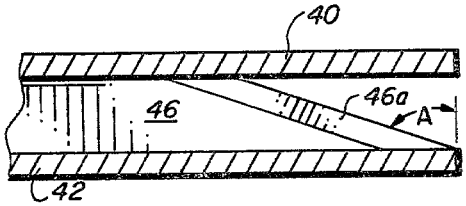
FIG. 4
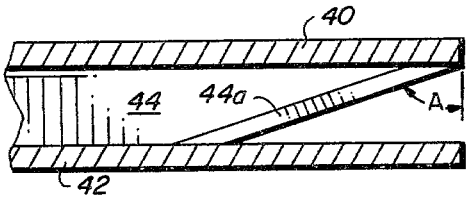
FIG. 5
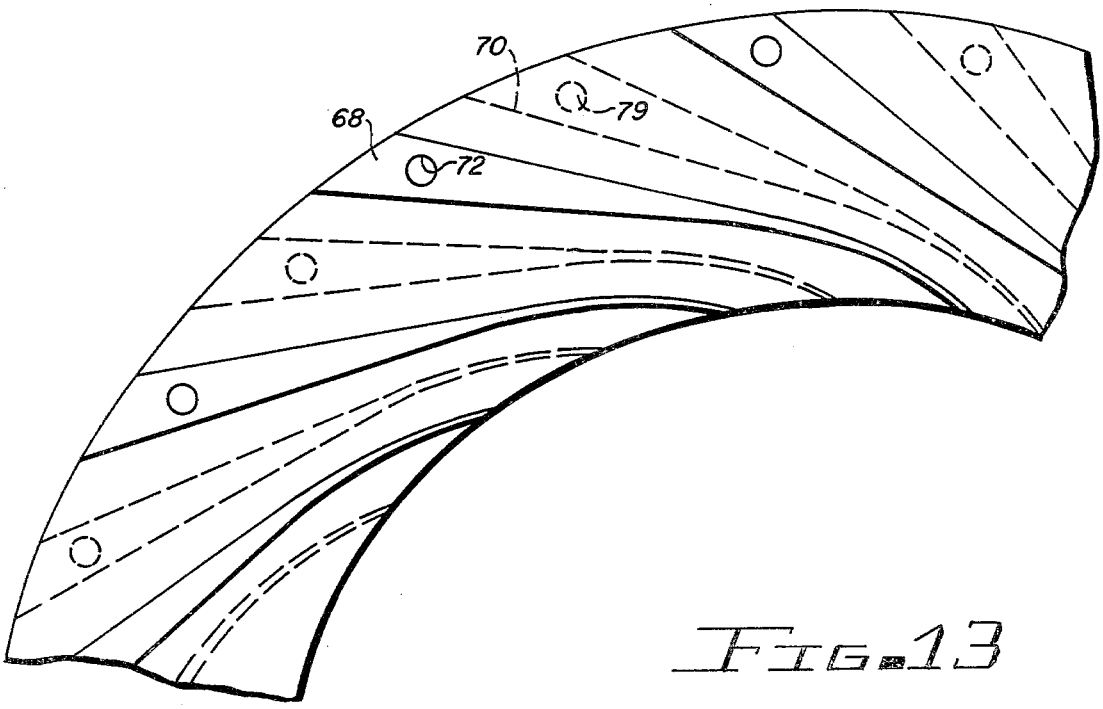
FIG. 13

COMPRESSOR DIFFUSER AND METHOD

BACKGROUND OF THE INVENTION

This invention relates to gas turbine engines and flow compressors utilized thereon, and relates more particularly to an improved diffuser design for use in conjunction with such compressors which exhaust fluid flow at transonic conditions.

Diffusers, such as annularly radial diffusers disposed about the periphery of the radial exit of a centrifugal compressor, function to diffuse the compressed flow by changing the velocity head thereof to an increased pressure. Thus, a diffuser typical to gas turbine engines has an inlet region receiving flow at transonic conditions, and a downstream portion wherein the flow is at subsonic conditions. For a variety of aerodynamic and mechanical efficiency reasons it is conventional practice to utilize vanes extending across the diffuser space. For instance, the vanes act as walls for intercepting boundary layer flows to prevent recirculation thereof back into the compressor. While utilization of vaneless diffusers have been known to the prior art, their applicability and utility is quite limited in practical situations.

It is well known that at transonic flow conditions near Mach 1 in instances, such as diffusers, wherein flow is bounded, the localized Mach number or flow velocity is highly sensitive to changes in flow per unit of cross-sectional area. Accordingly, abrupt changes of a small magnitude, such as about five percent, of the cross-sectional area of the flow passage drastically changes the localized Mach number thereby setting up shock waves and highly varying pressure fields. Such shock waves produce aerodynamic inefficiencies as well as causing certain undesirable mechanical effects such as stress and vibration in the adjacent impeller. Accordingly, it has been conventional practice to avoid emplacing vanes in the region of the diffuser subject to transonic conditions to avoid such shock waves. In the example of a centrifugal impeller, normally there is a vaneless space in the diffuser throughout the region of the diffuser inlet extending at least approximately ten percent of the radius of the radial exit of the impeller.

It has been found that this vaneless space adjacent the exit of the impeller causes a substantial buildup of boundary layer flow at both walls of the diffuser passage. Further, it is believed that the boundary layer flow tends to recirculate back into the compressor impeller rather than being carried radially outwardly along with the remaining flow through the diffuser simply because the boundary layer flow is of such relatively low velocity that it cannot penetrate the higher pressure downstream therefrom in the diffuser.

Another characteristic of rotary compressors is that the flow leaves the impeller and enters the diffuser with a significant nonuniform distribution of flow velocities. Efficient diffusion requires a general matching of the vane direction relative to this flow velocity distribution, and in particular in centrifugal impellers it is many times advantageous that the vanes of a diffuser have a small negative angle of incidence relative to the localized flow direction. (The sign convention normally utilized for the incidence of the vane is that the incidence becomes more positive with decrease in compressor flow.) Many times in the prior art this has resulted in a relatively complicated stator vane shape in the diffuser in order to produce a desired incidence distribution of the vane relative to the localized flow direction.

SUMMARY OF THE INVENTION

It is the primary object of the present invention to provide an improved vane structure and method for diffusers associated with compressor impellers such as utilized in gas turbine engines which extend into the transonic conditions existing in the diffuser in such a manner as to prohibit or minimize boundary layer flow buildup and recirculation into the compressor impeller, while at the same time avoiding shock waves normally accompanied with introduction of vanes into the transonic region.

Another important object of the present invention is to provide such an improved compressor diffuser and method as set forth in the preceding object wherein the angle of incidence of the vane in the entrance region, where transonic flow conditions may exist, is easily controlled with respect to localized flow conditions to produce the desired angle of incidence of the vane.

Another important object of the present invention is to provide an improved stator vane method and structure as set forth in the preceding objects wherein the entrance region the diffuser space has a substantially constant area at differing radial distances or a gradually increasing area with increasing radial distance in such a manner as to minimize formation of shock waves in the transonic flow region while still assuring that diffuser vanes may extend to a location immediately adjacent the exit of the impeller or the inlet of this diffuser passage in order to control boundary layer recirculation and buildup.

Another important object of the invention is to provide such a diffuser and method which provides a relatively slow rate of diffusion of the flow throughout the diffuser for improved efficiency and operational characteristics of the diffuser.

In summary, these objects and other advantages are accomplished by utilization of a diffuser vane having a highly swept leading edge of approximately seventy degrees sweep. Further, the vanes for a diffuser are made in two sets, one set having its leading edge extending from one diffuser wall toward the other, while the other set has its leading edge extending from the opposite wall. These oppositely swept stator vanes are then alternately spaced about the diffuser and, importantly, extend into the transonic region of the diffuser space. More specifically, the angle or direction of the swept portion of the diffuser vanes which lie in the transonic region of the diffuser space is arranged to maintain a desired negative angle of incidence across the width of the flow path. It has been found that the present invention leads to an extremely economical, easily produced diffuser structure wherein the stator vanes or at least the swept portion thereof may be made from sheet metal and in a relatively simple geometrical configuration while accomplishing all the objects and advantages set forth previously.

Through utilization of such structure and method it has been found that the present invention provides an improved surge margin for the compressor and the associated gas turbine engine, as well as improved efficiency throughout a variety of operational ranges of the compressor, particularly also improving part load operational efficiency of the compressor and/or gas turbine engine. Specifically, it is believed that the alternately swept configuration of the diffuser vanes introduces vane blockage so gradually that a substantially constant cross-sectional area of the diffuser space can be maintained to reduce pressure distortion at the impeller exit and thereby reduce stress imposed on the impeller. Further, the highly swept leading edges of the vanes allows the incidence to be optimized across a broad portion of the span or width of the associated diffuser passage with a very simple geometry. Further, the alternately swept configuration permits introduction of walls or fences for intercepting the boundary layer flow and avoiding recirculation thereof into the compressor impeller and further is believed to generate vortices which tend to delay flow separation from the walls of the diffuser passages.

These and other objects and advantages of the present invention are specifically set forth in or will become apparent from the following detailed description of preferred forms of the invention when read in conjunction with the accompanying drawings.

BRIEF DESCRIPTION OF THE DRAWINGS

FIG. 3 is a top plan view of the diffuser section with portions thereof removed to reveal details of construction;

FIG. 4 is an enlarged cross-sectional elevational view taken generally along lines 4—4 of FIG. 3;

FIG. 5 is an elevational cross-sectional view taken generally along lines 5—5 of FIG. 3;

FIG. 13 is a fragmentary top plan view similar to FIG. 3 but showing yet another form of the invention.

DETAILED DESCRIPTION OF THE PREFERRED EMBODIMENT

Figure 1:
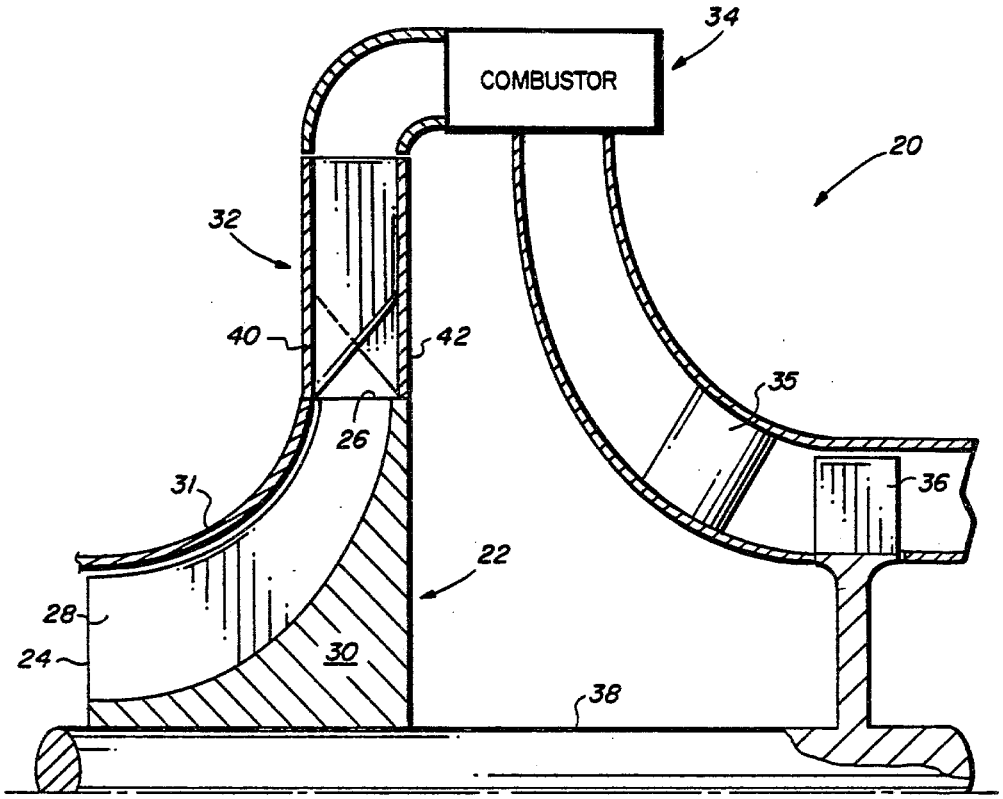
FIG. 1 is a partially schematic, partially cross-sectional view of a gas turbine engine as contemplated by the present invention with portions of the engine shown out of scale for simplicity of illustration.
Figure 2:
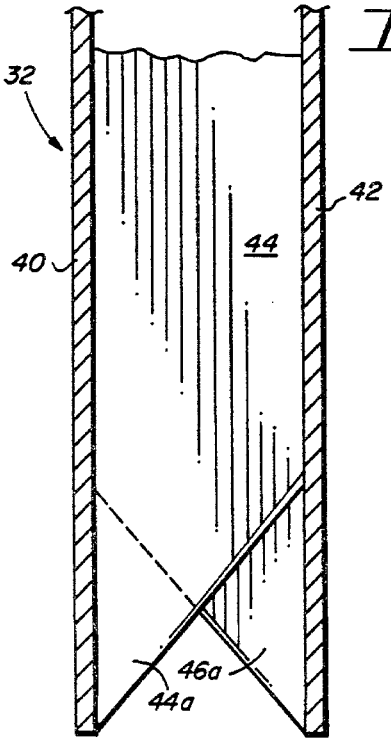
FIG. 2 is an enlarged, elevational, cross-sectional view of the inlet portion of the diffuser section of FIG. 1.

Referring now more particularly to FIGS. 1–7, a gas turbine engine generally referred to by the numeral 20 includes a radial centrifugal compressor section 22 having an axial inlet end 24 for receiving air flow and a radial exit end 26 for discharging higher pressure air flow. Compressor 22 has a plurality of radially arranged blades 28 in a conventional manner extending between the hub portion 30 and an outer edge of the blades adjacent a stationary shroud 31. Compressed air flow from compressor 22 passes through a diffuser section 32, described in greater detail below, which functions to change velocity head of air flow therein into a pressure head before delivery of the pressurized air flow to a combustor 34. Fuel flow is delivered to combustor 34 to establish a continuing combustion process therein, and the heated exhaust gas flow from the combustor passes across turbine nozzle vanes 35 and then through one or more turbine sections 36 in driving relation therewith. The turbine sections driven by the hot exhaust gas flow to perform useful work such as driving compressor 22 through a shaft 38. In general terms the gas turbine engine thus described is conventional in construction.

Diffuser section 32 is stationary and generally includes an outer sidewall 40 adjacent to or integral with the shroud 31, an opposed inner sidewall 42 adjacent and in alignment with the hub 30 of the compressor. Preferably, the inner sidewall 42 is located very closely to the radially outer end of the hub 30. Diffuser section 32 is annular in construction extending completely around the circular periphery of the circular, centrifugal compressor 22 for receiving all exhausting air flow from the compressor.

Extending between the inner and outer sidewalls 42 and 40 to divide the diffusing space therebetween into a plurality of diffuser passageways, are two sets of stationary diffuser of stator vanes 44 and 46. The sets of vanes 44 and 46 are alternately interposed between one another regularly around the annular diffuser section. As depicted in FIGS. 4 and 5, the vanes of the set 44 have highly swept leading edges, at an angle "A" of 60°–75° and nominally about 70° extending from outer wall 40 at a point thereon adjacent the inlet of the diffuser section to a point on the inner wall 42 substantially downstream from the inlet end of the diffuser section. The vanes of set 46 have leading edges which are also highly swept and preferably at the same angle "A" as those of set 44, but swept alternately relatively thereto, i.e., the vanes in set 46 have leading edges extending from inner wall 42 at a point adjacent the inlet end of the diffuser section to the outer wall 40 at a point thereon substantially downstream from the inlet end of the diffuser section.

The inner and outer sidewalls 42 and 40 are arranged substantially parallel to one another, and the vanes of the sets 44 and 46 extend generally perpendicularly across the diffuser space defined between the parallel sidewalls. The stator vanes of sets 44 and 46 may be each curved radially, as best depicted in FIG. 3, and extend toward the radially outermost end of the diffuser section 32, following directions as described in greater detail below, so that the diffuser passageways formed between the adjacent vanes of sets 44 and 46 generally begin with a logarithmic spiral configuration increasing in cross-sectional area and size relative to the direction of radial flow through the diffuser section. As illustrated in FIGS. 2–5 the swept leading edges of the vanes of sets 44 and 46 are straight, and may also have tapered knife edge sections 44A, 46A at their leading edge, that is the leading edge section is thinner than the remaining portion of the respective vanes of the sets 44, 46.

Figure 7:
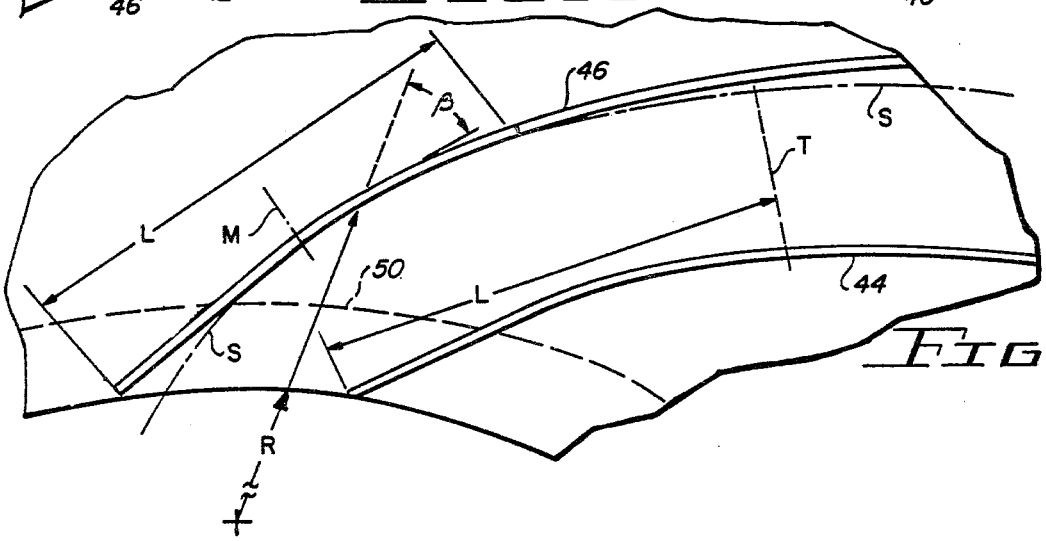
FIG. 7 is a further enlarged, fragmentary top plan view of the inlet of the diffuser section showing various geometrical parameters of a preferred form of the invention.

Details of one preferred geometry of the vanes of both sets 44 and 46 is illustrated in FIG. 7. Flow exiting the radial impeller is desired to flow through at the entrance region of the diffuser generally along and following a logarithmic spiral path in which the local flow angle at a given station, as measured from the local radial direction at that station, remains constant. This permits a slow rate of diffusion in the entrance region. Such a log spiral curve is illustrated by the line "S" in FIG. 7. The forward swept portion of vane 46 is denoted by "L," and the midpoint of the swept section which approximately coincides with the midpoint between the shroud and hub, is denoted as point "M." Upstream of point "M" the swept portion is straight and extends in a direction tangent to log spiral "S" at point "M." The remaining downstream segment of swept portion "L" is curved and generally coincident with log spiral "S." The further downstream, unswept portion of vane 46 is arranged in accord with normal design practice, normally slightly curved, to provide a diffuser passageway gradually increasing in size to produce the desired diffusion of air flow. Vane 44 is constructed in the same manner as vane 46. Accordingly, the throat of the diffuser passageway between adjacent vanes 44, 46, which is determined by the location where the passageway becomes bounded on all four sides, is shown at line "T" located at the end of the sweep length "L" of vane 44.

Figure 8A:
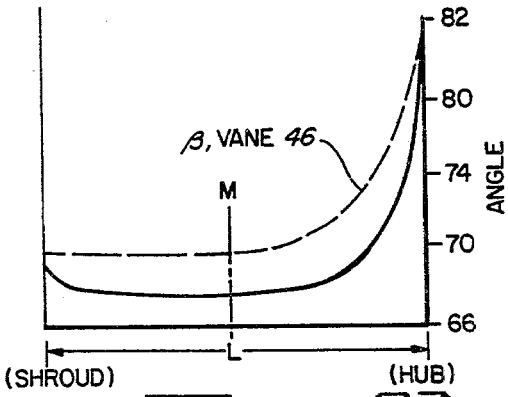
FIGS. 8A and 8B are graphs depicting the local angle of the diffuser vanes 46,44 in the inlet region of the diffuser section in comparison to the local flow angle thereat, but as viewed along projection extending along the sweep length of the vanes.
Figure 8B:
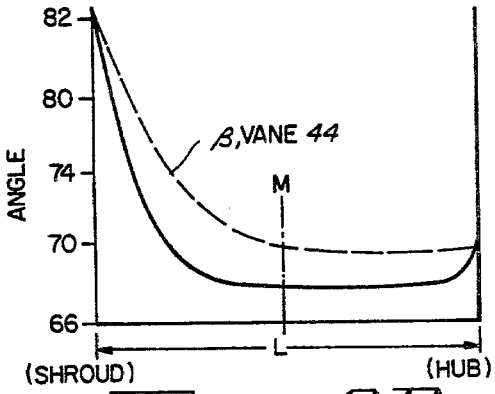
Figure 8:
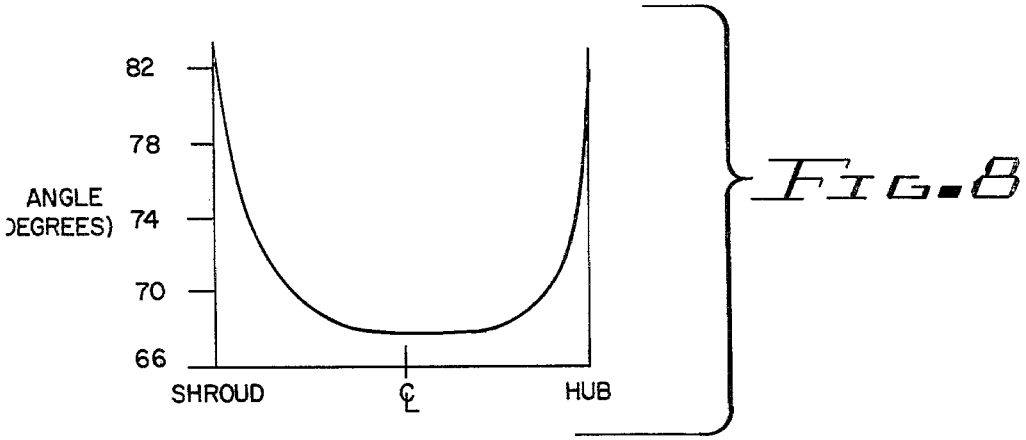
FIG. 8 is a graph of the flow profile at the entrance to the diffuser perpendicularly from shroud to hub.

FIG. 8 illustrates the flow angle perpendicularly across from the shroud to the hub as it exists when entering the diffuser. However, since the sets of vanes are alternately swept, the leading edges do not intercept the flow angle as depicted in FIG. 8. FIGS. 8A and 8B are graphs showing the flow angle, but as respectively projected along the sweep lengths "L" of vanes 46 and 44.

In the particular embodiment illustrated in FIG. 7, the straight portion of the vane which extends in a direction tangent to the log spiral at point "M," assures that the local vane angle "$\beta$" (the angle of a particular point or station of the vane as also measured from the local radial direction at that station) is at a desired, small negative angle of incidence relative to the local flow angle, as defined above, throughout a significant portion of sweep length "L." This is graphically illustrated in FIG. 8A which is a plot of the local vane angle "$\beta$" of vane 46, shown by a dashed line, in comparison to the local flow angle, shown by a solid line. At point "M" the vane angle "$\beta$" is chosen to have a desired negative angle of incidence (e.g., three degrees) to the flow angle. The angle of incidence is, of course, the difference between the solid and dashed curves in FIG. 8A. The straight portion of sweep length "L" extending upstream of "M" to the hub wall intercepts different local radial directions at different angles and, as shown in FIG. 8A, therefore approximates the flow angle between the shroud and point "M" and maintains a negative angle of incidence relative to the flow. Downstream from point "M," i.e., that part of FIG. 8A to the left of point "M," it is assumed that the flow has been sufficiently influenced by the adjacent vane so that the flow is parallel to the log spiral and thus the flow angle remains constant. Since this segment of the sweep length "L" of the vane is curved and generally coincident with the log spiral, the vane angle "$\beta$" also remains constant and maintains the desired negative angle of incidence to the flow.

It will be noted in FIG. 8A that adjacent the hub, the vane angle and flow angle become quite close to one another without negative angle of incidence. In certain embodiments it therefore may be necessary to reverse curve the extremely leading edge of the vane (i.e., to slightly increase the angle between an upstream portion of the swept vane section L in FIG. 7 relative to the illustrated log spiral curve line S).

FIG. 8B illustrates the like vane angle "$\beta$" of vane 44 in comparison to the local flow angle. As apparent, the desired negative angle of incidence of the vane 44 to the local flow direction is also maintained along a significant portion of the sweep length of vane 44. And similarly, the flow angle in the rightward portion of FIG. 8B has been sufficiently influenced by the other vane set 46 so as to remain substantially constant.

Through this geometry it can be seen that the diffuser vane itself can be made quite straightforwardly from sheet metal or the like and comprises a straight section and two slightly differently curved sections readily producible in mass production with the accuracy necessary.

The particular angles discussed above and the manner of determining those angles are exemplary in nature. The primary consideration for the direction and location of the diffuser vanes relates to the desired operation of the diffuser. Specifically, in the sweep length "L" of the diffuser vanes, as discussed above, it is important to maintain a negative angle of incidence throughout as much a length thereof as possible. Thus, the leading edge and sweep portions "L" of the vanes are located so as to provide the negative angle of incidence as illustrated in FIGS. 8A and 8B. The portions of the vanes downstream of the sweep lengths are so arranged to provide the desired diffusion operation of the diffuser, i.e, this downstream portion is arranged to provide a gradually increasing area producing the desired diffusion of the air flow therein, following normal design practice.

In operation, the compressed air flow from compressor 22 discharges through radial exit 26 at transonic velocity on the order of 0.80 to 1.5 Mach number. Thus, there exists a "transonic zone" within the diffuser space that is illustrated in FIG. 7 as extending from the inlet of the diffuser 32 to the dashed line 50. In most instances the transonic zone extends a radial distance of approximately ten percent of the predetermined exit radius "R" of the centrifugal impeller 22 which is substantially equivalent to the radius of the inlet end of the diffuser. It is important to note that in the present invention the two sets of vanes 44, 46 extend substantially through this transonic zone up to the inlet end of the diffuser. This is in contrast to prior art arrangements wherein the transonic zone is characteristically maintained vaneless. The relatively thin leading edge of the vane 44, 46 along with their highly swept configuration permits the introduction of metal in the entrance region or transonic zone at a very low, gradual rate relative to the radial location of the vane so that the diffuser passageways remain substantially constant, or increase in cross-sectional area in this transonic zone for increasing radial distances from the inlet end of the diffuser. This therefore closely approximates the transonic area ruling concept wherein the total area of the diffuser passageways or diffuser space in the transonic or entrance zone remains almost constant.

By avoiding an abrupt reduction of cross-sectional area of the diffuser space, shock waves, pressure variations, etc. are significantly avoided. In this respect it is well known that at velocities near Mach one the localized Mach number is highly sensitive to changes in cross-sectional area of the flow space. That is near Mach one, a small change in cross-sectional area causes a large localized Mach number change to the flow. This large rapid change in localized Mach number results in shock waves, pressure fields, etc.

The gradual introduction of metal into the diffuser space afforded by the highly swept vanes 44, 46 also gradually accommodates variations in local flow direction, and give a relatively gradual pressure rise over the length of the diffuser. This is believed not only to minimize shock waves but also to assure that the diffuser section can accept shock waves with a minimum aerodynamic inefficiency.

It is further believed that the highly swept configuration of the sets of vanes 44, 46 permit the diffuser section to work efficiently in a broader range at off-design compressor impeller conditions. Specifically, the high angle of attack afforded by the highly swept vanes are believed analogous in operation to a highly swept aircraft wing to provide a broad angle of attack and thus operate more efficiently at off-design conditions.

Preferably, the swept portion "L" of the sets of vanes are so arranged so as to maintain a substantially constant cross-sectional area up to the throat of the diffuser passageways. Downstream of this throat the diffuser passageways begin a gradual increase in cross-sectional area in order to perform the diffusion function by reducing the flow velocity and translating this flow velocity into an increased static pressure.

The alternate sweeping of the two sets of vanes 44, 46 provides the boundaries or "fences" to intercept and interrupt boundary layer flow at both inner wall 42 and outer wall 40 adjacent to the impeller exit. As discussed previously, it is believed that these vanes in the entrance region minimize recirculation of boundary layer and adjacent flow back into the compressor.

Figure 9:
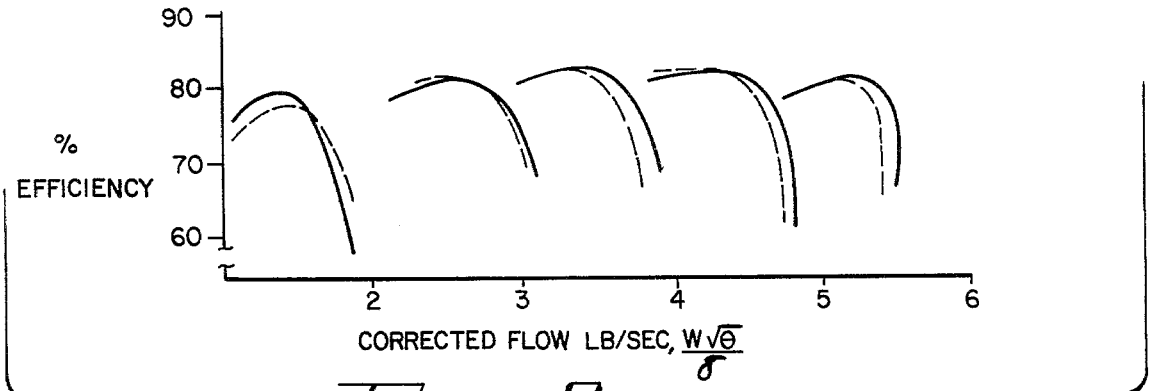
FIG. 9 is a graph depicting the improved efficiency performance offered by the present invention.

In sum, it has been found that the diffuser configuration of the present invention provides a significant increase in diffuser efficiency as well as improving the surge margin thereof. As illustrated in FIG. 9 a comparison of the present invention efficiency performance (shown in solid lines) to a baseline performance of an arrangement not utilizing the present invention (shown in dashed lines) shows a significant performance increase at a variety of compressor speeds. The family of curves illustrated in FIG. 9 correspond to different compressor speeds. In addition to improving engine and diffuser performance at design speed (the right-most set of curves in FIG. 9), the present invention also provides significant surge margin increase at lower, off-design speeds as shown in FIG. 10 where, again, performance of the present invention is shown by a solid line in comparison to a baseline engine performance shown by dashed lines. It is believed this is partially attributable to the broad angle of attack afforded by the highly swept diffuser vanes 44, 46, as well as the interruption and interception of boundary layer flow at both sidewalls as discussed in detail above.

Figure 10:
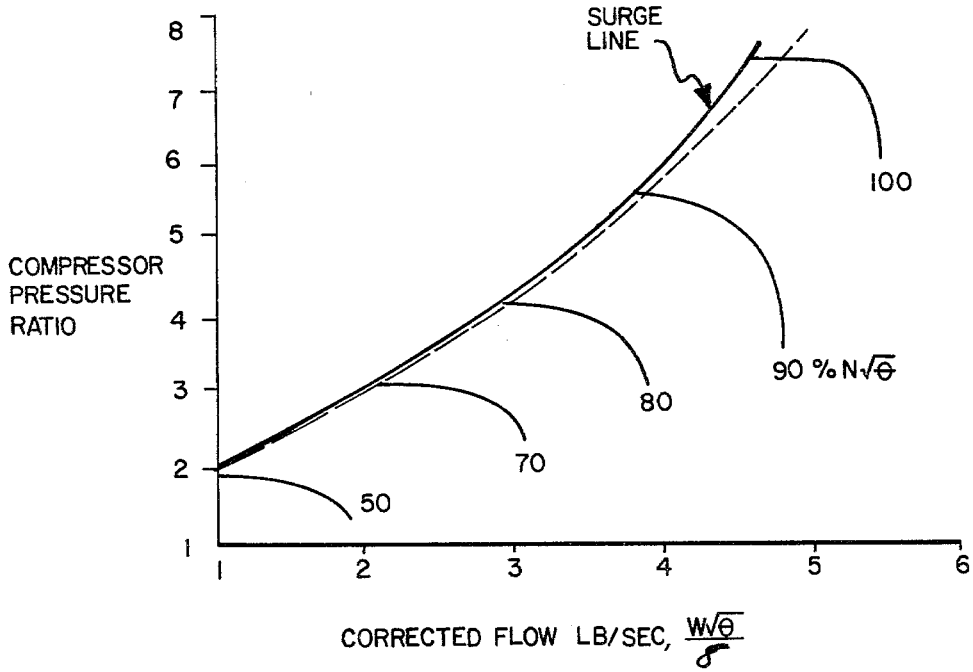
FIG. 10 is a graph depicting the improved surge margin performance offered by the present invention to a gas turbine engine.

The present invention also provides improved engine performance at conditions lower than transonic as shown by the improved low speed conditions in FIGS. 9 and 10.

Figure 11:
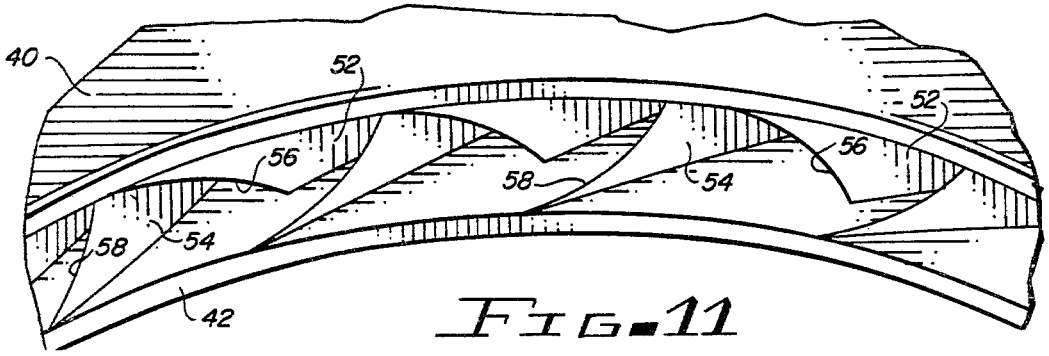
FIG. 11 is a fragmentary perspective view similar to FIG. 6 but showing an alternate form of the invention.

An alternate form of the invention is illustrated in FIG. 11. The overall structure is similar to that illustrated in FIGS. 1–7 with the exception that the two sets of vanes 52, 54 have highly swept leading edges 56, 58 which are also curved. The purpose of such curvature or scarfing is, in certain applications, to better fit the angle of incidence of the leading edge of the vanes to the localized flow angle. In this respect, FIG. 11 illustrates an application of the present invention which incorporates curved leading edge configurations as known in the prior art such as in U.S. Pat. No. 2,967,013 to Dallenbach et al. Dependent upon the flow angle profile of a particular machine, one set of vanes may be curved as illustrated in FIG. 11, while the other set could have straight leading edges as shown in FIGS. 1–6.

Figure 12:
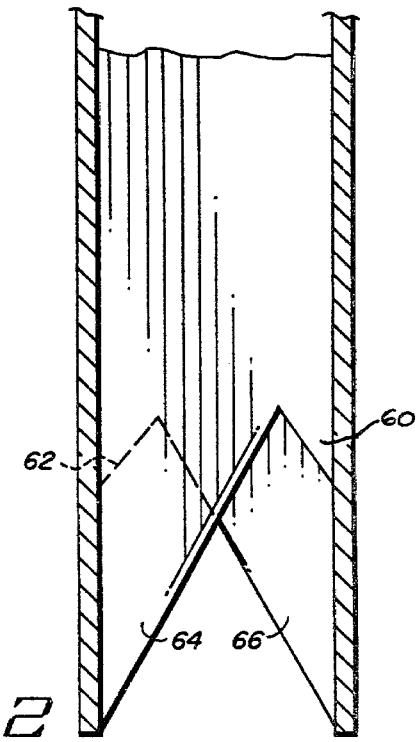
FIG. 12 is a fragmentary elevational view similar to FIG. 2 but showing another form of the invention.
Figure 6:
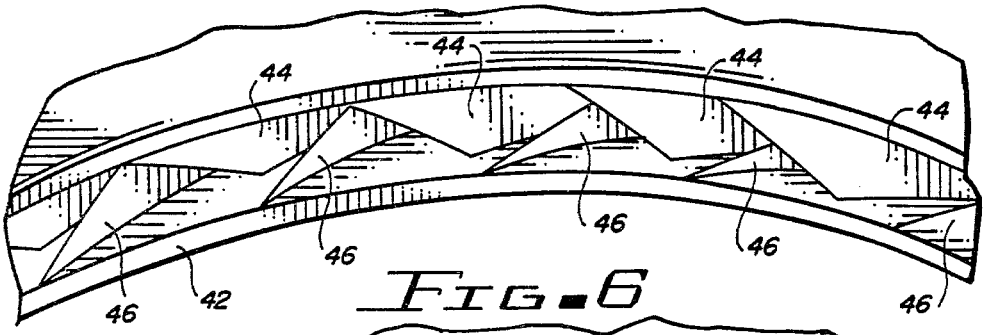
FIG. 6 is an enlarged, fragmentary perspective of the view of the inlet of the diffuser section.

FIG. 12 illustrates an alternate embodiment of the invention which attempts to better match the localized flow angle and the vane angle adjacent the end portion of the sweep length "L" by incorporation of a reverse "tooth" portion 60, 62 at the rear end of the sets of vanes 64, 66. From FIGS. 11 and 12 therefore it would be apparent to those skilled in the art that a variety of configurations of the highly swept portion "L" of the alternately swept vanes as contemplated by the present invention may be utilized in order to approximate the localized flow angle to the vane angle corresponding thereto without departing from the principles of the present invention. Specifically, it is noted that in both FIGS. 11 and 12 the two sets of vanes are alternately swept and alternatedly interposed regularly about the periphery of a compressor, and both sets of vanes have the highly swept leading edge portions which extend into and substantially through the transonic inlet retion or zone of the diffuser space.

FIG. 13 illustrates yet another alternate arrangement of the invention, and specifically shows application of the principles of the present invention to vanes having greater thickness. Specifically, vanes having thick sections are illustrated in FIG. 13 with two sets of vanes 68, 70. For clarity of illustration, one set of vanes 68 is shown in solid lines of FIG. 13 while the alternately disposed set of vanes 70 is shown in dashed lines. Being of a larger size with greater mechanical strength, the radially outer sections of these two sets of vanes 68 and 70 are of substantially greater width yet while providing the gradually increasing cross-sectional area required to produce the desired diffusing action. The rear end sections of these vanes 68, 70 are sufficiently large so as to accept securing bolts (not shown) through apertures 72, 74 therein. The arrangement illustrated in FIG. 13 incorporates the principles of the present invention by including highly swept leading edge portions which extend into the transonic zone of the inlet region of the diffuser. Further, the vanes of set 68 are swept alternately to those vanes of set 70 in this region.

Various other modification and alterations to the embodiments specifically described above will be apparent to those skilled in the art. Accordingly, the foregoing detailed description should be considered exemplary in detail and not as limiting to the scope and spirit of the present invention.

Having described the invention with sufficient clarity that those skilled in the art may make and use it, I claim:

1. A method of diffusing pressurized exhaust flow exiting a compressor at transonic conditions, comprising:

delivering the exhaust flow into a diffuser space bounded by inner and outer sidewalls at transonic conditions at the inlet end of the diffuser space and in a generally logarithmic sprial direction;

intercepting boundary layer flow at both of said inner and outer sidewalls in the region of said diffusing space subject to said transonic conditions; and maintaining the cross-sectional area of said diffusing space approximately constant or gradually increasing at increasing distances from said inlet end in the region of said diffuser space subject to said transonic conditions.

2. A method of diffusing pressurized exhaust flow exiting a compressor at transonic conditions, comprising:

delivering the exhaust flow, at transonic conditions and in a generally logarithmic spiral direction, into the inlet of a diffuser space bounded by inner and outer sidewalls and having operatively positioned therein a first mutually spaced plurality of vanes and a second mutually spaced plurality of vanes interdigitated with said first plurality of vanes;

intercepting boundary layer flow at said inner sidewall immediately adjacent said inlet end only with said first plurality of vanes in the diffuser space; and intercepting boundary layer flow at said outer sidewall immediately adjacent said inlet end only with said second plurality of vanes in the diffuser space.

3. A diffuser for a fluid flow compressor, comprising inner and outer spaced sidewalls defining an inlet end of said diffuser adapted to receive fluid flow from the compressor; first and second sets of stator vanes extending between said inner and outer sidewalls with leading edges at said inlet end, said leading edges of said stator vanes of the first set being swept from said inner sidewall to said outer sidewall and said leading edges of said stator vanes of the second set being swept from said outer sidewall to said inner sidewall, said stator vanes of the first set being alternately interposed between said stator vanes of the second set.

4. For use with a fluid flow compressor, a circular diffuser section having opposed sidewalls, a flow inlet end, and a plurality of stator vanes extending between said sidewalls and spaced regularly about said diffuser section with leading edges adjacent said inlet end, said leading edges of adjacent ones of the stator vanes being alternately swept from one opposed sidewall to the other.

5. In combination with a rotary flow impeller having a hub, a shroud, and a plurality of blades extending from said hub toward said shroud, a diffuser downstream of said impeller having an inlet for receiving compressed flow from said impeller, said diffuser comprising:

spaced inner and outer sidewalls located generally respectively adjacent said hub and shroud;

a first set of stator vanes extending between said inner and outer sidewalls, each of said stator vanes of the first set having a leading edge swept from said inner sidewall to said outer sidewall; and a second set of stator vanes extending between said inner and outer sidewalls, each of said stator vanes of the second set having a leading edge swept from said outer sidewall to said inner sidewall, said stator vanes of the second set being alternately interposed between said stator vanes of the first set.

6. A radial flow compressor comprising:

a centrifugal impeller having hub and shroud sides and a peripheral exit passage for compressed flow:

a diffuser disposed about said peripheral exit passage with an inlet end for receiving and diffusing said compressed flow from said peripheral exit passage, said diffuser having inner and outer sidewalls generally aligned respectively with said hub and shroud sides, and first and second sets of a plurality of stator vanes extending between said inner and outer sidewalls, said vanes of the first set being alternately interposed between those of the second set, said vanes of the first set having leading edges extending from said inner sidewall at a point thereon adjacent said inlet end to said outer sidewall at a point thereon downstream of said inlet end, said vanes of the second set having leading edges extending from said outer sidewall at a point thereon adjacent said inlet end to said inner sidewall at a point thereon downstream of said inlet end.

7. A radial compressor comprising:

a centrifugal impeller having a radial exit at a predetermined exit radius;

a diffuser having parallel sidewalls defining a diffuser space therebetween and an inlet end disposed immediately adjacent to and receiving flow from said radial exit of the impeller; and diffuser vanes extending from each of said sidewalls toward the other thereof, said vanes having leading edges spaced outwardly from said exit radius no more than approximately five percent of said exit radius, said leading edges being swept at an angle of between 60 degrees and 75 degrees measured from a direction perpendicular to said sidewalls.

8. A gas turbine engine comprising:

a centrifugal compressor having a fluid flow inlet, a radial fluid flow exit, a hub side, a shroud side, and a plurality of impeller blades extending from said hub side toward said shroud side;

a combustor for heating compressed fluid flow received from said compressor;

a turbine driven by said heated flow from said combustor, said turbine operably coupled with said compressor to drive the latter; and a stationary radial diffuser having inner and outer radially extending sidewalls generally respectively aligned with said hub and shroud sides of the compressor, a circular entrance adjacent said exit of the compressor for receiving compressed flow therefrom, and first and second sets of stator vanes extending between said inner and outer sidewalls with leading edges adjacent said entrance, said stator vanes of the first set being alternately interposed between said stator vanes of the second set, said leading edges of the stator vanes of the first set being swept oppositely from said leading edges of the stator vanes of the second set.

9. In a radial diffuser having inner and outer sidewalls defining a space therebetween for diffusing fluid flow therethrough, first and second sets of a plurality of stator vanes extending across said space to divide the latter into a plurality of passageways, said vanes of the first set being alternately interposed between said vanes of the second set, said vanes of the first set having leading edges swept from said inner wall to said outer wall relative to the direction of flow in said space, said vanes of the second set having leading edges swept from said outer wall to said inner wall relative to said direction of flow.

10. A diffuser as set forth in claim 9, wherein said inner and outer sidewalls are generally parallel and said stator vanes of the first and second sets extend generally perpendicularly to said sidewalls.

11. A diffuser as set forth in claim 10, wherein said stator vanes of the first and second sets are curved radially for at least a part of their length whereby said passageways have generally logarithmic spiral configurations increasing in size relative to said direction of flow.

12. A centrifugal compressor comprising:

a rotary centrifugal impeller having a hub, impeller blades extending from said hub and a radial exit, said impeller operable to discharge flow through said radial exit in a generally logarithmic spiral direction;

a shroud at the ends of said impeller blades remote from said hub;

inner and outer parallel sidewalls extending radially outwardly from said radial exit and generally respectively aligned with said hub and shroud at said radial exit, said inner and outer sidewalls defining a diffuser space therebetween having a circular inlet receiving flow discharged from said radial exit;

a first set of diffuser vanes extending generally perpendicularly from said inner sidewall toward said outer sidewall, first set having relatively straight, inclined leading edges swept at approximately 70 degrees from a direction perpendicular to said sidewalls and defining swept portions of the vanes, said swept portions extending from immediately adjacent said circular inlet at said inner sidewalls to a downstream portion said outer wall, said swept portions extending generally in a direction at a preselected angle of incidence to the tangent to said logarithmic spiral at approximately the midpoint of the length of said swept portions;

a second set of diffuser vanes extending generally perpendicular from said outer sidewall toward said inner sidewall, said second set having relatively straight, inclined leading edges swept at approximately 70 degrees from a direction perpendicular to said sidewalls and defining swept portions of the vanes, said swept portions extending from immediately adjacent said circular inlet at said outer sidewall to a downstream portion said inner wall, said swept portions extending generally in a direction at a preselected angle of incidence tangent to said logarithmic spiral at approximately the midpoint of the length of said swept portions;

said vanes of the second set being alternately interposed between said vanes of the first set equidistantly about said circular inlet, said vanes of the first and second sets having downstream portions extending in a downstream direction from said respective points on the outer and inner walls to define fully bounded diffuser passages between adjacent vanes, said downstream portions extending in directions preselected to provide a preselected rate of increase in the cross-sectional areas of said diffuser passages in said downstream direction.

13. A compressor as set forth in claim 12, wherein said preselected angle of incidence is approximately minus three degrees at said midpoint.

14. A compressor as set forth in claim 12, wherein said direction of the downstream portion of each particular vane is tangent to said logarithmic spiral at approximately the entrance of said fully bounded diffuser passage associated with the said particular vanes on the side thereof in the direction of rotation of said impeller.

15. A compressor as set forth in claim 13, wherein said direction of the downstream portion of each particular vane is tangent to said logarithmic spiral at approximately the entrance of said fully bounded diffuser passage associated with the said particular vanes on the side thereof in the direction of rotation of said impeller.

16. A compressor as set forth in claim 12, 13, 14 or 15, wherein said vanes of said first and second sets are configured and arranged whereby the cross-sectional area of said diffuser space remains substantially constant or gradually increases at increasing distances from said circular inlet in the region of said diffuser space containing said swept portions of the vanes of said first and second sets.

17. A compressor as set forth in claim 12, 13, 14 or 15, wherein said swept portions of the vanes of the first and second sets extend in directions maintaining a small negative angle of incidence relative to the local flow direction from said midpoint of the length of the swept portions toward said circular inlet.

18. A compressor as set forth in claim 17, wherein the directions of said vanes of the first and second sets at said circular inlet approximately coincide with the local flow direction thereof.

19. A compressor as set forth in claim 18, wherein said vanes of said first and second sets are configured and arranged whereby the cross-sectional area of said diffuser space remains substantially constant or gradually increases at increasing distances from said circular inlet in the region of said diffuser space containing said swept portions of the vanes of said first and second sets.

* * * * *